United States Patent [19]

Victor

[11] 4,041,558

[45] Aug. 16, 1977

[54] SHEETROCK HOLE PUNCHER AND NAIL SETTER

[76] Inventor: Harvey Victor, 24 Back Drive, Edison, N.J. 08817

[21] Appl. No.: 684,666

[22] Filed: May 10, 1976

[51] Int. Cl.[2] ..... B25C 3/00; B26F 1/32

[52] U.S. Cl. ..... 7/14.1 R; 30/358; 145/46

[58] Field of Search ..... 145/46; 30/358, 359; 7/17, 14.1 R

[56] References Cited

U.S. PATENT DOCUMENTS

| | | | |
|---|---|---|---|
| 1,458,961 | 6/1923 | Williams | 145/46 X |
| 1,802,282 | 4/1931 | Siemer | 30/358 |
| 1,922,614 | 8/1933 | Bradshaw | 30/358 |
| 2,250,434 | 7/1941 | Dugaw | 145/46 X |

*Primary Examiner*—Jimmy C. Peters
*Attorney, Agent, or Firm*—Joel Halpern

[57] ABSTRACT

A sheetrock hole puncher and nail setter includes an impact tool and a cutting tool adapted to be releasably secured thereto. The impact tool is given an elongated shank having an enlarged head at one end adapted to receive impact blows and a cutting tool-receiving nail set head at the other end. The nail set head is formed in its lower surface with a central annular threaded recess. A cutting tool has a threaded section at one end threadable into the threaded recess of the impact tool to releasably secure the cutting tool thereto and has a hollow cylindrical cutting edge at its other end.

3 Claims, 5 Drawing Figures

SHEETROCK HOLE PUNCHER AND NAIL SETTER

BACKGROUND OF THE INVENTION

The present invention relates to carpenters' tools and more particularly to a nail set tool adapted especially for the setting of nails in sheetrock.

Nail set tools have been well known heretofore. Generally, they have comprised an impact receiving shaft or shank positioned resiliently within a casing. U.S. Pat. No. 2,979,092 issued Apr. 11, 1961 to R. J. Bradford discloses a tool of such character. U.S. Pat. No. 1,458,961 issued June 19, 1923 to S. T. Williams also discloses a hand tool of this general type in which a removable tool end is provided in order to permit the tool to be used for other purposes such as for use as a center punch.

The driving and countersinking of nails in sheetrock produce certain problems not encountered in working with wood members and is attributable to the nature of the material. Thus, sheetrock is susceptible to varying degrees of disintegration as a result of the direct driving of nails thereinto, and it is also difficult to provide for countersinking of such nails without risking a marring of the surface of the sheetrock through consequent chipping, flaking, etc., of the material under the influence of the impact blows. It has, therefore, created the need for a special tool capable of driving nails and of countersinking such nails into the sheetrock without the aforesaid risks of damage to the sheetrock surface which requires finishing treatment such as puttying, sanding and the like.

SUMMARY OF THE INVENTION

It is one object of the invention to provide a nail set tool for sheetrock which obviates the need for subsequent surface treatment steps to correct damage which may result from the driving of the nails into the sheetrock.

It is another object of the invention to provide a nail set tool for sheetrock which is capable of providing for the driving and countersinking of nails with minimal risk of surface damage to the sheetrock.

Other objects and advantages of the invention will become readily apparent from the following description of the invention.

According to the present invention there is provided a sheetrock hole puncher and nail setter comprising in combination: an impact tool including an elongated shank having an enlarged head at one end thereof adapted to receive impact blows delivered thereto, the other end of the shank having a cutting tool-receiving set head, the central portion of the lower surface of the nail set being provided with an annular threaded recess therein; and an elongate cutting tool including a body having a hollow cutting section at one end thereof and a threaded section at the other end thereof adapted to threadedly engage with the threads in the recess of the nail set head to thereby releasably secure the cutting tool to said impact tool.

BRIEF DESCRIPTION OF THE DRAWINGS

In order that the invention may be more fully comprehended it will now be desribed, by way of example, with reference to the accompanying drawings in which.

DETAILED DESCRIPTION OF THE INVENTION

Figure 1:
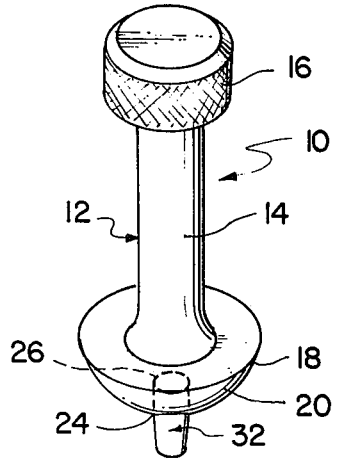
FIG. 1 is an elevational view of the nail set tool of the invention poised above a sheetrock surface.
Figure 2:
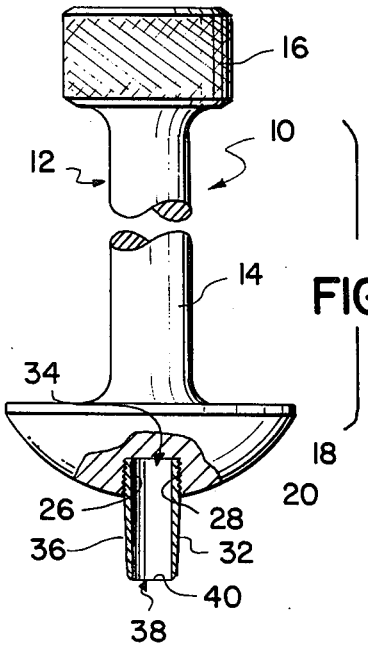
FIG. 2 is an elevational view similar to FIG. 1, partly broken away to show the relationship between the impact and cutting tool components.
Figure 5:
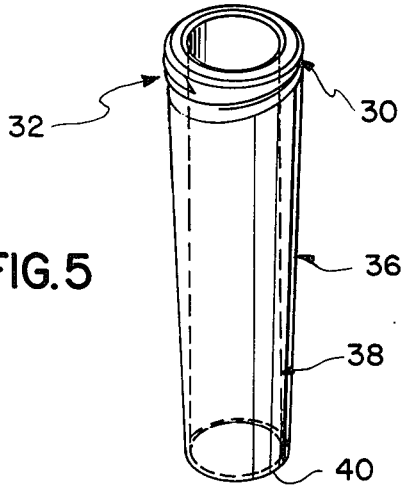
FIG. 5 is a perspective view of the cutting tool component.
Figure 3:
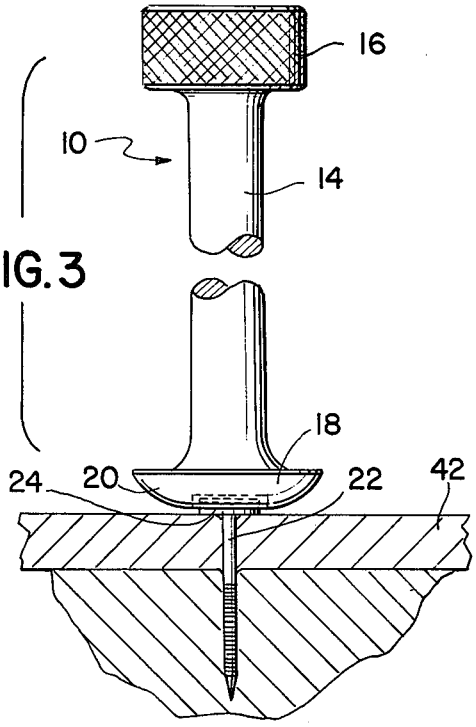
FIG. 3 is an elevational view, broken, showing the impact tool relative to a nail already partially driven into the sheetrock.
Figure 4:
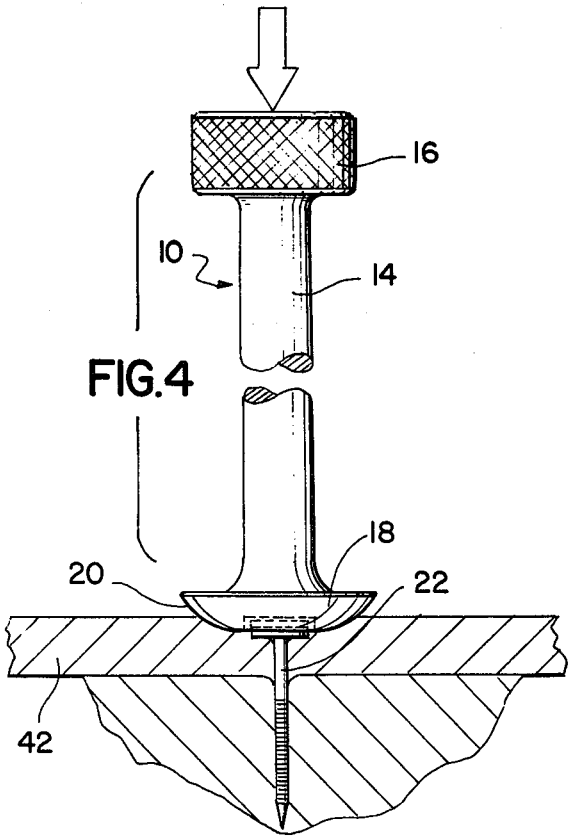
FIG. 4 is a view similar to that of FIG. 3, showing the relationship between the impact tool, the nail and the sheetrock when the nail is countersunk into the sheetrock.

Referring to the drawings there is generally, as indicated by reference numeral 10, a nail set tool. The tool comprises two separable components. The first of such components is an impact tool 12 which consists of an elongated shank 14 having an enlarged head 16 at one extremity thereof and a cutting tool-receiving nail set head 18 at the other extremity thereof. The impact tool is desirably formed in a single integral section. The nail set head 18 is dished upwardly to thereby provide a curved surface 20 which is useful in the countersinking of a nail 22. The central portion 24 of the lower surface of the nail set head is desirably flat and is given a recess or blind bore 26 therein concentric with the longitudinal axis of the tool. The recess is internally threaded as at 28 and is dimensioned to releasably receive the upper threaded section 30 of the second component of the tool 10, i.e., the cutting tool 32. To facilitate driving of the nail into the sheetrock the base of the recess is located sufficiently close to the lower surface of the nail set head so as to be cooperable with a nail head to permit the driving of the nail into the sheetrock in countersunk relation therewith.

The cutting tool 32 comprises a body portion 36 having at one end thereof a threaded section 30 adapted to threadedly engage with the threads 28 of recess 26 to thereby releasably secure the cutting tool to the impact tool. The other end of the body portion 36 is provided with a hollow cutting section 38 the peripheral edge 40 of which is adapted to be easily driven into the sheetrock for removal of a plug of material therefrom. Desirably the cutting section 38 is tapered slightly towards the outer extremity thereof so as to expedite removal of the sheetrock material from the hole formed.

It will thus be understood that operation with the tool of the invention includes a first hole-punching step in which the cutting tool is secured to the impact tool and then one or more blows are delivered to the head 16 as by a hammer. The cutting section of the tool enters the sheetrock 42 and forms a hole therein. Withdrawal of the tool leaves a hole for the nail 22. It will, of course, be understood that the diameter of the cutting section need not be the same size as the diameter of the nail, and a set of cutting tools can be provided with cutting sections embracing a range of diameters such that a cutting tool of the desired cutting section diameter can be selected depending upon the size of the nail to be used. The second step involves removal of the cutting tool from the recess of the impact tool, placement of the nail head within such recess, and driving of the nail into the sheetrock.

Although applicant does not wish to be bound by any particular theory of operation it is believed that by providing the nail set head 18 with the dished configuration about the flattened central portion a distribution of stresses is applied to the sheetrock surface which permits driving and countersinking without attendant surface damage to the sheetrock material.

From the foregoing it will be seen that a unique two-component hand tool has been provided which is especially suitable for the driving and countersinking of nails into sheetrock without risk of causing surface damage to the sheetrock which requires time consuming finishing treatment.

I claim:

1. A sheetrock nail setter comprising in combination: an impact tool including an elongated shank having an enlarged head at one end thereof adapted to receive impact blows delivered thereto, the other end of said shank having a cutting tool-receiving nail set head, the central portion of the lower surface of said nail set head being provided with a recess therein, the base of said recess being located sufficiently close to the lower surface of said nail set head as to be cooperable with a nail head to drive same into the sheetrock in countersunk relation therewith, said nail set head being dished upwardly from said central portion thereof to a level above the base of said recess and thus cooperable with said base to permit countersinking of the nail.

2. A sheetrock nail setter according to claim 1, wherein said recess is internally threaded and including an elongate cutting tool having a body with a hollow cutting section at one end thereof and a threaded section at the other end thereof adapted to threadedly engage with the threads in the recess of said nail set head to thereby releasably secure said cutting tool to said impact tool.

3. A sheetrock hole puncher and nail set according to claim 2, wherein said cutting section is tapered towards the outer extremity thereof.

* * * * *

UNITED STATES PATENT OFFICE

CERTIFICATE OF CORRECTION

Patent No. 4,041,558 Dated August 16, 1977

Inventor(s) Harvey Victor

It is certified that error appears in the above-identified patent and that said Letters Patent are hereby corrected as shown below:

All occurrences of the trademark "SHEETROCK" should read --plaster wallboard-- and specifically on the cover page, in the title "SHEETROCK" should read --plaster wallboard--; and in the first line of the Abstract "sheetrock" should read --plaster wallboard--.

In column 1 in the title the word "SHEETROCK" should read --plaster wallboard--; and in each of lines 8; 19; 21; 30; 31; 37; 39-40; 42; 44; 49; and 68 the misused term "sheetrock" should read --plaster wallboard--.

In column 2, in each of lines 6; 9; 9-10; 33; 36; 44-45; 48; 54; and 65 the misused term "sheetrock" should read --plaster wallboard--.

In column 3, in each of lines 2; 4; 8; and 9 the misused term "sheetrock" should read --plaster wallboard--.

In Claim 1, in each of lines 1, and 11 thereof the misused term "sheetrock" should read --plaster wallboard--.

In Claim 2, first line thereof the misused term "sheetrock" should read --plaster wallboard--.

UNITED STATES PATENT AND TRADEMARK OFFICE

CERTIFICATE OF CORRECTION

PATENT NO. : 4,041,558

DATED : August 16, 1977

INVENTOR(S) : Harvey Victor

It is certified that error appears in the above—identified patent and that said Letters Patent is hereby corrected as shown below:

In Claim 3, first line thereof the misused term "sheet-rock" should read -- plaster wallboard --.

Signed and Sealed this

*Tenth* Day of *June 1980*

[SEAL]

*Attest:*

SIDNEY A. DIAMOND

*Attesting Officer*

*Commissioner of Patents and Trademarks*